United States Patent [19]

Beatty et al.

[11] 4,378,747

[45] Apr. 5, 1983

[54] AQUATIC RECREATION VEHICLE

[76] Inventors: Theodore D. Beatty, 20911 Skimmer La., Huntington Beach, Calif. 92646; James J. Beatty, 5573 Rainier St., Ventura, Calif. 93003

[21] Appl. No.: 170,317

[22] Filed: Jul. 18, 1980

[51] Int. Cl.[3] ..... B63B 5/24

[52] U.S. Cl. ..... 114/56; 441/72; 114/288

[58] Field of Search ..... 9/310 R, 310 B, 310 E; 114/56, 85, 61, 270, 271, 291, 283, 288–290, 363; 441/65, 74, 79, 72

[56] References Cited

U.S. PATENT DOCUMENTS

| | | | |
|---|---|---|---|
| 3,561,025 | 2/1971 | Teach | 9/7 |
| 3,982,497 | 9/1976 | Caron | 114/270 |
| 3,989,002 | 11/1976 | Peterson | 114/270 |
| 4,091,761 | 5/1978 | Fehn | 114/290 |

*Primary Examiner*—Charles E. Frankfort
*Assistant Examiner*—D. W. Keen
*Attorney, Agent, or Firm*—K. H. Boswell; Edward D. O'Brian

[57] ABSTRACT

An aquatic recreation vehicle susceptible to use by one or a group of passengers or crew has an integrally formed hull having a plurality of surfaces. The hull is symmetrical about a central vertical symmetry plane which essentially divides the hull longitudinally in half. The surfaces include at least three longitudinally extending sections and at least two longitudinally extending pressure ridges. The pressure ridges are symmetrically located on the bottom of the hull and are inwardly directed toward the vertical symmetry plane. At least two longitudinally extending runners are located on the hull to provide high speed planing lift. The hull surfaces are curved upward at the bow to provide smooth entry into the water. A superstructure is located on the hull and extends longitudinally along a portion of the length of the hull. The combined centers of gravity and buoyancy of the hull and superstructure normally lie essentially in the same vertical symmetry plane. The superstructure includes a longitudinally oriented crew seating member which the crew members straddle one behind the other along the length of the superstructure. During turns the crew are able to shift their center of gravity toward the apex of the turn depressing the pressure ridge on the side of the vehicle toward the apex of the turn to control the vehicle in the turn.

10 Claims, 6 Drawing Figures

18
54
38
24
58
30
10
60
40
10
26
62
34
68
14
64
12
50
20
22
16

54
58
56
60
52
48
48
66
6
6
62
66
68
14
70
66
50
22
64
16

AQUATIC RECREATION VEHICLE

BACKGROUND OF THE INVENTION

This invention relates to an aquatic vehicle having a hull and a superstructure. The hull includes pressure ridges located below the static water line and the superstructure allows for tandem seating of the crew. During turns the crew members shift their weight into the apex of the turn thus shifting the center of gravity of the vehicle over the pressure ridges allowing for control of the vehicle in the turn. The hull is shaped to allow navigation of shallow waters.

Over the centuries numerous shaped boats have been developed. In the past several decades, recreation vehicles have assumed a significant share of the boat market. Generally these recreation vehicles fall into two classes—power boats and sail boats. In the power boat class there are a variety of uses for which the boats are designed.

For use in fishing and the like, hull design, superstructure design and other similar factors are not as critical as for boats designed for high speed travel. For pulling water skiers and for racing, hull design is extremely critical for both speed and handling. In ski boats, racing boats and the like, many design considerations must be made to properly balance engine size or displacement with hull design. Additionally, because of recent shortages of fossil fuels boat designers no longer have the liberty of increasing speed or performance by simply increasing engine displacement. Fuel economy in recreation vehicles has become a prime consideration in both their design and use.

Currently for water skiing, outboards, stern-drives or water jets are used to propel the boat. The greater majority of these boats are sized to hold a number of occupants or passengers. Unfortunately unless these boats are equipped with a large fuel inefficient engine they are unable to adequately pull a skier out of the water when filled at or near the passenger capacity level. The weight of the passengers slow the boat down beyond the point where it can successfully pull the skier fast enough to lift him out of the water. Therefore, in order to pull a skier the boat has to be loaded below capacity, thus wasting the primary purpose for sizing the boat.

Recently there has been introduced water vehicles which are ridden by a single person and give that person an effect similar to that of skiing. One such vehicle is known under the trade name of a "Jet Ski". While these vehicles are quite exhilarating and thrilling to ride they are not suitable for operation by a child and generally anyone unskilled in the operation of a motorcycle-like vehicle. Further, since they can only be ridden by a single person at a time they cannot be utilized by a family as a group.

BRIEF SUMMARY OF THE INVENTION

In view of the above it is felt there exists a need for an aquatic recreation vehicle which, because it is not oversized, does not demand the expenditure of large amounts of fuel for its operation but still can transport a group of passengers, and is capable of towing a water skier. Further, it is felt there exists a need for an aquatic recreation vehicle which can be adapted to accept a variety of propulsion systems such as an outboard motor, a water jet and the like.

It is therefore a primary object of this invention to provide an aquatic recreation vehicle which is capable of navigation through shallow waters, which is useful in both inland and open waters, which is readily trailer transportable because of its small size and light weight, and is safe to use by a group of passengers.

These and other objects as will become evident from the remainder of the specification are achieved in an aquatic vehicle capable of buoying and transporting one or more crew members which comprises: a hull symmetrical about a longitudinally extending, centrally located, vertical symmetry plane; said hull having a plurality of integrally formed longitudinally extending surfaces; said surfaces including at least three longitudinally extending sections and at least two longitudinally extending pressure ridges symmetrically located to the right and left of said symmetry plane, each of said pressure ridges inwardly directed toward said symmetry plane, each of said pressure ridges interspaced between two of said hull sections; said sections of said hull and said pressure ridges curving downwardly from the fore end of said hull and extending backwardly to the aft end of said hull; a longitudinally extending superstructure located over said hull extending along a portion of the length of said hull; said vertical symmetry plane dissecting said superstructure along its longitudinal axis into essentially symmetrical right and left side halves; the combined centers of gravity and buoyancy of said hull and said superstructure normally lying essentially in said vertical symmetry plane; said superstructure including a longitudinally oriented crew supporting means located above the center of buoyancy of said vehicle, said crew supporting means sized to allow one or more of said crew members to individually straddle said supporting means such that if two or more crew members occupy said vehicle, said crew members are aligned tandemly one behind the other along the length of said supporting means; said crew members capable of freely shifting their center of gravity from a position directly over the center of buoyancy of said vehicle to positions to the right or left of a point directly over the center of buoyancy of said vehicle such that when said center of gravity of said crew is shifted to the right or left of a point directly over the center of buoyancy of said vehicle said pressure ridge located on said side of said vertical symmetry plane to which said center of gravity is shifted will be depressed downwardly with respect to the static water line of said vehicle.

Preferredly the hull will contain runner means extending longitudinally along at least a portion of the hull to provide high speed planing surfaces. Preferredly the runner means comprise horizontally oriented, longitudinally extending runners integrally formed on the hull which are capable of planing on the surface of a body of water when said hull is propelled at or above a planing velocity.

The aft end of the hull includes a motor receiving means which preferredly is adapted to receive an outboard motor. Alternately, the aft end of the hull including the superstructure can receive an inboard engine useful for a stern-drive or a water jet type propulsion system.

Preferredly the hull includes two pressure ridges and the sections of the hull include three bilge sections. Each of said pressure ridges comprises an arcuate surface extending between the fore and aft ends of the hull—the arcuate surfaces being inwardly and downwardly directed and the pressure ridges being located between the bilge sections.

Preferredly the hull would include three runner sections, one each located adjacent to and on the outboard side of each of the two pressure ridges and the third runner section located down the center line of the hull. In this configuration the hull would include two outboard bilge sections located outboard the two outboard runners respectively and two inboard bilge sections located between the center runner and the pressure ridges respectively.

The superstructure can be augmented by including appropriate cowling at the front and rear providing for streamlining of the superstructure and location of appropriate controls and the like. Also included in the superstructure would be appropriate rails or other hand holds for use by the passengers of the vehicle. Additionally a deck extending over the upper surface of the hull can include foot railings useful for bracing of the passengers' feet. This assists the crew in shifting their weight when it is desirable to shift the center of gravity of the vehicle.

BRIEF DESCRIPTION OF THE DRAWINGS

This invention wil be better understood when taken in conjunction with the drawings wherein.

Figure 1:
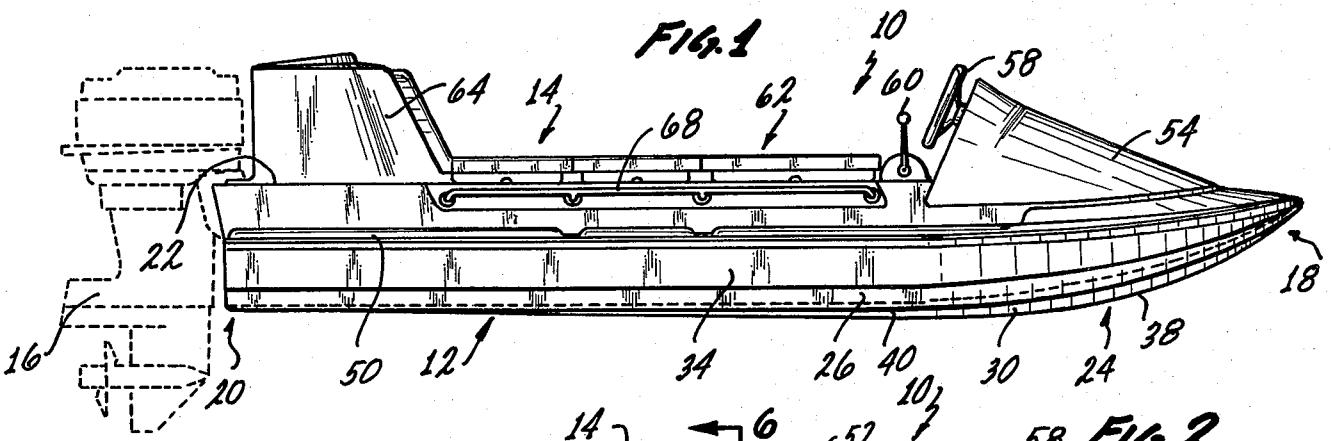
FIG. 1 is a side elevational view showing the aquatic recreation vehicle of the invention.
Figure 2:
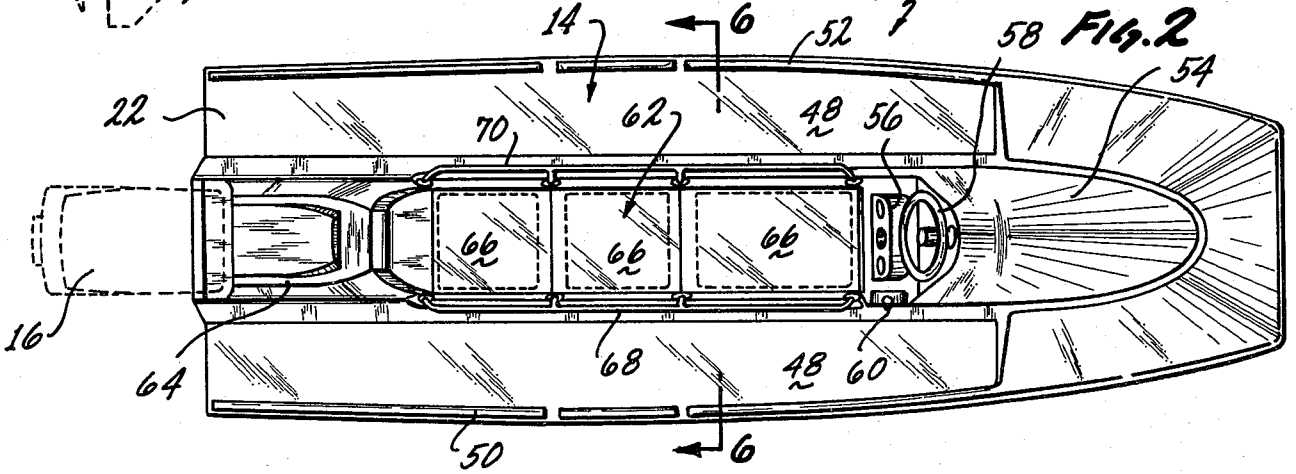
FIG. 2 is a top plan view of the vehicle shown in FIG. 1.
Figure 3:
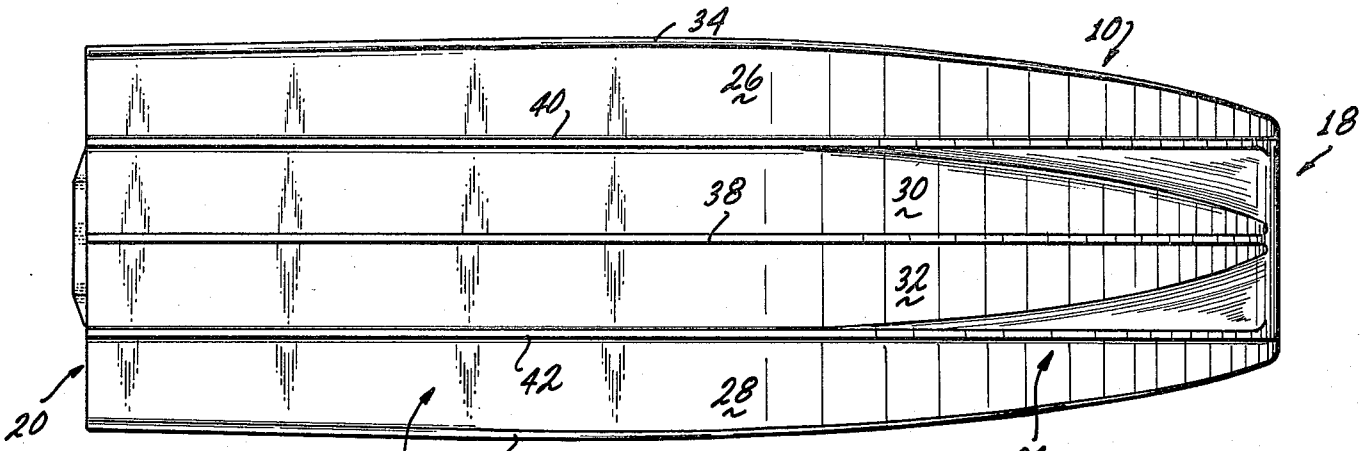
FIG. 3 is a bottom plan view of the vehicle shown in FIG. 1.

This invention as illustrated in the claims and described in this specification utilizes certain principles and/or concepts as are set forth and claimed in the claims appended to this specification. Those skilled in the boat building arts will realize that the principles and/or concepts as set forth in the claims can be applied to a number of differently appearing embodiments which differ from the preferred embodiment described herein, but which do not depart from the spirit or scope of the claims. In view of this, this invention is to be construed in light of the claims and is not to be construed as being limited to the exact embodiment herein illustrated.

DETAILED DESCRIPTION

The aquatic recreation vehicle 10 hereinafter noted simply as the vehicle 10 has two main sections. These are the hull 12 and the superstructure 14. While it does not form a part of the invention per se, for completeness in understanding the invention, an outboard motor 16 is also shown in phantom lines in the drawing. The motor 16 is shown as a typical prop driven motor. Alternately the vehicle 10 of the invention could be equipped with a jet propulsion type system or water jet, as is commonly employed in certain recreation vehicles. While not primarily designed to be equipped with an inboard engine, the vehicle 10 could be so equipped by modifying certain portions of the superstructure to enlarge the area at the rear of the vehicle to incorporate such an inboard engine. Alternately an inboard engine could be used with a typical stern-drive unit commercially available.

The hull 12 as seen from the figures generally is of a modified cathedral type design. As viewed in FIG. 1 in side view, the last two-thirds of the hull are generally flat while the first one-third of the hull gently curves upwardly to the bow 18. The aft end 20 of the hull 12 is generally square and includes a compound transom 22 which is adapted to receive motor 16. In the embodiment illustrated the bow 18 is shown as curving inwardly, then being squared off in front. This is the preferred configuration; however, a pointed bow would also be suitable. In any event, the bow includes an area 24 which is an extension of other parts of the hull 12 as hereinafter explained which is shaped to cut into the water and thus soften the ride.

Figure 5:
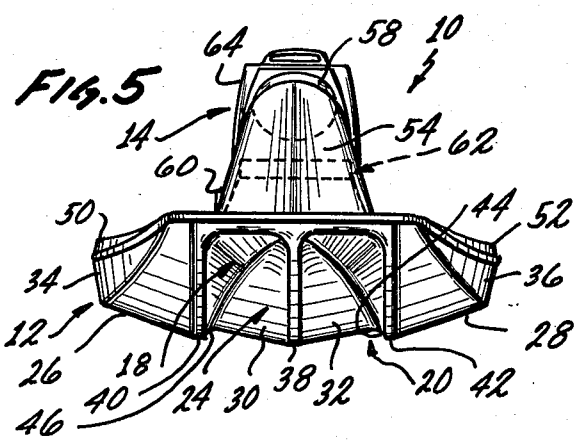
FIG. 5 is an end elevational view showing the fore end of the vehicle in FIG. 1.

The hull 12 is composed of a plurality of surfaces which are integrally formed together, preferably in one monolith structure. The bottom of the hull 12 includes four longitudinally oriented bilge sections, left and right outside bilge sections 26 and 28, and left and right inside bilge sections 30 and 32. The hull 12 is designed such that the line where the left and right side freeboards 34 and 36 join the left and right outside bilge sections 26 and 28 is at approximately the static water line for most of the hull except, of course, the area immediately adjacent to the bow. Near the bow the freeboards 34 and 36, and the outside bilge sections 26 and 28, curve in as is best seen in FIG. 5.

Extending down the midline along the bottom of the hull is the center runner 38. Immediately adjacent the inside edges of the left and right outside bilges 26 and 28 are the left and right side runners 40 and 42. The center runner and left and right side runners 38, 40 and 42 extend from the bow 18 longitudinally down the hull 12 to the aft end 20. The runners serve as horizontally oriented surfaces providing surfaces for hydrodynamic forces to support the boat during high speed travel or planing.

As is evident from the drawing the hull 12 as well as the superstructure 14 has a longitudinal symmetry. That is, there is a vertical plane of symmetry which extends longitudinally down the vehicle 10 horizontally through the center runner 38 up into the superstructure 14. It can thus be seen that freeboard 34, left outside bilge 26, left runner 40 and left inside bilge 30 are mirror images of their right side counterparts.

Figure 4:
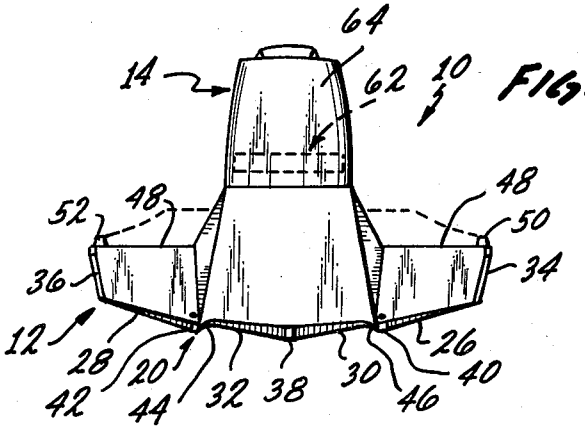
FIG. 4 is an end elevational view showing the aft end of the vehicle in FIG. 1.

Extending longitudinally immediately inside the left and right side runners 40 and 42 toward the center of the hull 12 are left and right side pressure ridges 44 and 46. The pressure ridges 44 and 46 extend along the full length of the hull 12 from the bow 18 to the aft end 20. These pressure ridges are inwardly and downwardly directed. On the bow end 18 of the hull 12 the radius of the pressure ridges 44 and 46 is slightly greater than the radius of the pressure ridges further on toward the aft end 20. This creates the area 24 noted earlier. The significance of this increase of radius lies in softening the ride of the vehicle 10 as it cuts through the waves the vehicle 10 encounters in its motion. As can be seen in FIG. 4 the pressure ridges 44 and 46 extend completely to the transom 22. As will be hereinafter explained the pressure ridges 44 and 46 provide for directional stability during turns of the vehicle 10. This stability can be increased by tapering the radius of the pressure ridges 44 and 46 to a smaller radii toward the aft end 20 of the vehicle 10. Thus, any volume of water collected near the bow in the larger radii pressure ridge will be compressed as the vehicle 10 moves forward on this water because of the narrowing of the radii toward the aft end 20.

A deck 48 is located on the surface of the hull 12. Adjacent to the edges of the deck 48 near the freeboards 34 and 36 are left and right side toe rails 50 and 52. The toe rails serve as a bracing point for the crew's feet as well as convenient handles to assist in boarding the vehicle 10 directly from the water as will be the case in a swimmer boarding the vehicle. Preferredly the surface of the deck 48 would be a non-slick surface which would further assist gripping of the crew's feet on the deck 48. The crew members can apply pressure to the deck 48 with their legs to assist in shifting the center of gravity of the loaded vehicle.

The superstructure 14 reading from the bow end 18 to the aft end 20 of the vehicle 10 includes a front cowling 54, an instrument panel 56 including a steering wheel 58, an appropriate engine control 60, the seating section 62 and a rear cowling 64. The seating section 62 includes appropriate seats 66 extending between the instrument panel 56 and the rear cowling 64. Left and right side grab rails 68 and 70 extend along the appropriate side of the seating section 62. The grab rails are positioned to allow passengers of the vehicle 10 to comfortably hold on to them when they are seated in the seating section 62. The passengers of the vehicle 10 straddle the seat 66 placing their feet on the right and left sides of the deck 48. Normally the vehicle 10 will hold from one to four passengers.

Figure 6:
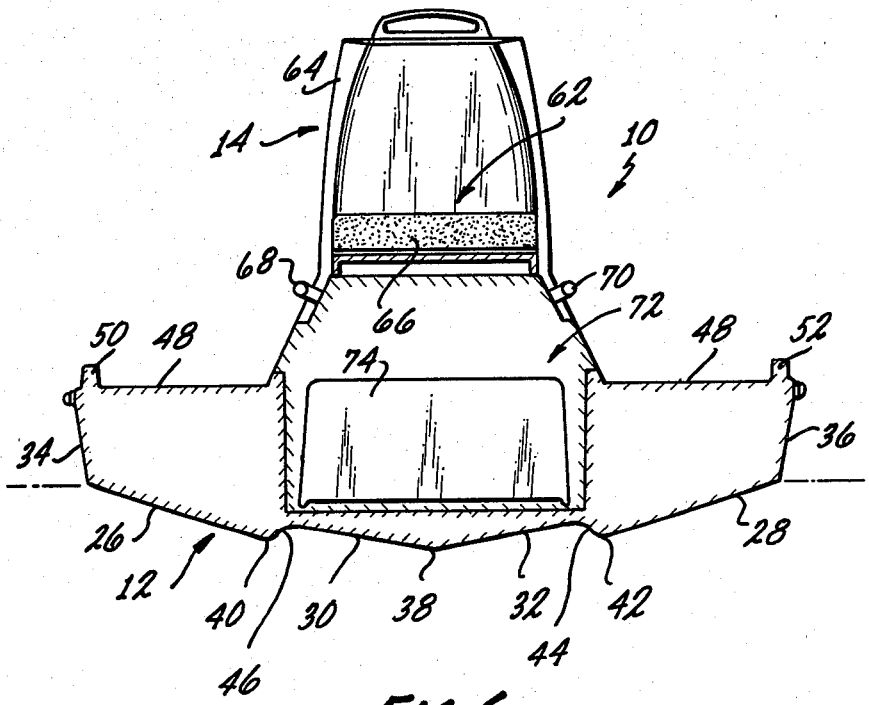
FIG. 6 is an end elevational view in section about the line 3—3 of FIG. 2.

Located beneath the seating section 62 is a fuel and battery storage section 72. In FIG. 6 the fuel tank 74 is seen in cross-section. The batteries (not numbered or illustrated) would be appropriately placed in the center of the vehicle 10 in a manner similar to the fuel tank 74.

The insides of the hull 12 directly above the left and right outside bilge sections 26 and 28 preferredly would be filled with a lightweight, water impervious material such as polyurethane foam to provide for safety and buoyancy. Only the center section of the vehicle 10, i.e., the fuel and battery storage section 72, would remain hollow.

As is evident from the above description and as previously noted there is a longitudinal plane of symmetry straight down the middle of the vehicle 10. The unoccupied vehicle 10, therefore, has its center of gravity in the same vertical plane as is its center of buoyancy. The crew of the vehicle 10 sit astride the seats 66 and thus their combined center of gravity also falls in the longitudinal plane of symmetry going down the center of the vehicle 10. The passengers, however, are not fixed, but are free to lean to the right or left of the plane of symmetry of the vehicle 10 and thus can shift the combined center of gravity of themselves and the vehicle 10 to the right or left of the symmetry plane. In the preferred embodiment of the invention, the unloaded vehicle 10, excluding the engine, fuel weight, etc., would weigh approximately 225 to 250 pounds. The passenger load would contribute from approximately 150 pounds to approximately 700 pounds of weight. It thus can be seen that the shifting of the body position of the crew to the right or left of the vehicle 10, i.e., shifting their center of gravity, will influence the center of gravity of the occupied vehicle significantly. The crew on the vehicle, because they sit astride the seats 66, are able to influence the vehicle much in the same way that a motorcycle rider, and/or rider and passenger, are able to influence a motorcycle.

When in use during turning the vehicle 10 is heeled to the right or left depending of course whether a right or left turn is being made. When making a turn the crew of the vehicle, i.e., the passengers, including the driver, lean toward the apex of the turn and thus shift their center of gravity and consequently the center of gravity of the loaded vehicle toward the apex of the turn. This depresses that side of the hull 12 which is toward the apex of the turn which consequently depresses the pressure ridge on that side with respect to the static water line of the vehicle. Depressing the pressure ridge closest to the apex of the turn effectively causes that pressure ridge to form a cutting edge below the water surface to effectively eliminate any side slip of the vehicle 10 due to the centrifugal force of the turn. The crew of the vehicle 10 by shifting their weight toward the apex of the turn increases the fluid loading in the pressure ridge to effectively counteract the centrifugal force. This counteraction of centrifugal force is caused by increasing the fluid pressure and as such the friction between the water and the appropriate portions of the hull 12.

Because of the narrow beam of the vehicle 10 combined with the tandem astride placement of the crew, the crew can effectively change the center of gravity of the vehicle during turns to take advantage of the above noted physical forces. This is totally contrary to other known recreational water vehicles which do not rely on the shift of center of gravity of the crew. For maximum effect of this unique feature of this invention, compression of the captured water flow along the left and right pressure ridges 44 and 46 is facilitated by decreasing the center of radii of these pressure ridges as previously noted. In use, the vehicle 10 and the combined crew are united into a single working unit.

When equipped with a 40 hp outboard engine the typical vehicle 10 and a crew of four can expect to achieve speeds of up to 40 mph. There is sufficient power with a 40 hp motor to adequately tow a water skier. Furthermore, since the hull configuration is very flat the vehicle 10 is able to navigate very shallow waters. A jet propulsion system can easily be adapted to the vehicle 10 in place of the outboard motor 16 with a slight loss of top vehicle speed. This loss of speed, however, is countered by an increase in safety because no longer is there an exposed prop. While the vehicle 10 is primarily designed for recreational purposes it is evident that it is readily adaptable to other uses.

The weight of the motor 16 would of course be counterbalanced with respect to fore-aft symmetry by placement of the fuel tank 74 and battery (not shown or numbered) toward the bow 18 of the vehicle 10.

Because the crew are seated in a tandem arrangement, one behind the other on the seats 66 of the vehicle 10, it matters not whether there is an odd or even number of crew members in maintaining the symmetrical placement of the weight of the crew members on the vehicle 10. This is contrary to a more conventional boat wherein if an odd number of crew members is present it is impossible to evenly distribute them in a side by side arrangement in pairs.

Because of the size of the vehicle and its light weight it is easily transported on a trailer and is conveniently launched either by using a ramp or simply by lifting the vehicle from the trailer and depositing it in a body of water.

Preferredly the vehicle 10 will be constructed using fiberglass construction techniques. Thus, the hull 12 and the majority of the superstructure 14 including the deck 48 would all be made of fiberglass. As noted before the right and left sides of the hull 12 would be filled with a lightweight floatable material such as polyurethane. The seats 66, the steering and engine controls 58 and 60, and the rails 50, 52, 68 and 70 would be formed of appropriate material suitable for use in the construction, such as fabrics, foams, wood or metal. Alternately, parts of the vehicle such as the hull 12 could be formed of a suitable flexible material such as neoprene rubber. As so constructed, a suitable chamber capable of being inflated would be utilized to provide structural support. Such a vehicle would be useful in scuba diving where the vehicle could be left unattended near rocks or reefs and the like. The seats 66 can be attached to the seat sections 62 with hinges to provide storage areas underneath the seats 66.

We claim:

1. An aquatic vehicle capable of buoying and transporting one or more crew members which comprises:

a hull symmetrical about a longitudinally extending, centrally located, vertical symmetry plane;

said hull having a plurality of integrally formed longitudinally extending surfaces;

said surfaces including at least three longitudinally extending sections and at least two longitudinally extending pressure ridges symmetrically located to the right and left of said vertical symmetry plane, each of said pressure ridges downwardly and inwardly directed toward said symmetry plane, each of said pressure ridges interspaced between two of said hull sections;

said sections of said hull and said pressure ridges curving outwardly and downwardly from the fore end of said hull and extending backwardly to the aft end of said hull said pressure ridges diverging from points adjacent said symmetry plane at said fore end;

said hull including a deck forming the uppermost surface of the hull;

a longitudinally extending superstructure located over said hull extending along a portion of the length of said hull upwardly from said deck;

said vertical symmetry plane dissecting said superstructure along its longitudinal axis into essentially symmetrical right and left side halves;

the combined centers of gravity and buoyancy of said hull and said superstructure normally lying essentially in said vertical symmetry plane;

said superstructure including a longitudinally oriented crew supporting means located above the center of buoyancy of said vehicle, and projecting upwardly from said deck, said deck extending from said crew supporting means outwardly to the right and the left of said vertical symmetry plane, said crew supporting means sized and shaped to allow one or more of said crew members to individually straddle said supporting means such that if two or more crew members occupy said vehicle, said crew members are aligned tandemly one behind the other along the length of said supporting means and each of said crew members independently can sit astride said crew supporting means with their legs projecting downwardly and outwardly towards said deck with their feet locatable on said deck;

said crew members capable of freely shifting their center of gravity from a position directly over the center of buoyancy of said vehicle to positions to the right or left of a point directly over the center of buoyancy of said vehicle such that when the center of gravity of said crew is shifted to the right or left of a point directly over the center of buoyancy of said vehicle, said pressure ridge located on said side of said vertical symmetry plane to which said center of gravity is shifted will be depressed downwardly with respect to the static water line of said vehicle.

2. An aquatic vehicle capable of buoying and transporting one or more crew members which comprises:

a hull symmetrical about a longitudinally extending, centrally located, vertical symmetry plane;

said hull having a plurality of integrally formed longitudinally extending surfaces;

said surface including at least three longitudinally extending sections and at least two longitudinally extending pressure ridges symmetrically located to the right and left of said vertical symmetry plane, each of said pressure ridges downwardly and inwardly directed toward said symmetry plane, each of said pressure ridges interspaced between two of said hull sections;

said sections of said hull and said pressure ridges curving downwardly from the fore end of said hull and extending backwardly to the aft end of said hull;

said hull including a deck forming the uppermost surface of the hull;

a longitudinally extending superstructure located over said hull extending along a portion of the length of said hull upwardly from said deck;

said vertical symmetry plane dissecting said superstructure along its longitudinal axis into essentially symmetrical right and left side halves;

the combined centers of gravity and buoyancy of said hull and said superstructure normally lying essentially in said vertical symmetry plane;

said superstructure including a longitudinally oriented crew supporting means located above the center of buoyancy of said vehicle, and projecting upwardly from said deck, said deck extending from said crew suporting means outwardly to the right and the left of said vertical symmetry plane, said crew supporting means sized and shaped to allow one or more crew members to individually straddle said supporting means such that if two or more crew members occupy said vehicle, said crew members are aligned tandemly one behind the other along the length of said supporting means and each of said crew members independently can sit astride said crew supporting means with their legs projecting downwardly and outwardly towards said deck with their feet locatable on said deck;

said crew members capable of freely shifting their center of gravity from a position directly over the center of buoyancy of said vehicle to positions to the right and left such that when the center of gravity of said crew is shifted to the right or left of a point directly over the center of buoyancy of said vehicle, said pressure ridge located on said side of said vertical symmetry plane to which said center of gravity is shifted will be depressed downwardly with respect to the static water line of said vehicle;

runner means located on said hull and extending longitudinally along at least a portion of the length of said hull;

said runner means comprise horizontally oriented, longitudinally extending runners capable of planing on the surface of a body of water when said hull is propelled at a planing velocity across said surface of said body of water.

3. The vehicle of claim 2 including: the aft end of said hull having motor receiving means capable of receiving a motor to propel said vehicle on said body of water.

4. The vehicle of claim 3 wherein: said hull includes at least three bilge sections, one of said bilge sections located between two of said pressure ridges and the other of said bilge sections each having one of said pressure ridges located intermittent said bilge section and said vertical symmetry plane.

5. The vehicle of claim 4 wherein: each of said pressure ridges comprises an inwardly and downwardly directed arcuate surface extending between the fore and aft end of said hull.

6. The vehicle of claim 5 wherein: the radii of said arcuate surface at said fore end of said pressure ridge is greater than the radii of said arcuate surface at said aft end of said pressure ridge.

7. An aquatic vehicle capable of buoying and transporting one or more crew members which comprises:

a hull symmetrical about a longitudinally extending, centrally located, vertical symmetry plane;

said hull having a plurality of integrally formed longitudinally extending surfaces;

said surfaces including at least three longitudinally extending sections and at least two longitudinally extending pressure ridges symmetrically located to the right and left of said vertical symmetry plane, each of said pressure ridges downwardly and inwardly directed toward said symmetry plane, each of said pressure ridges interspaced between two of said hull sections;

said sections of said hull and said pressure ridges curving downwardly from the fore end of said hull and extending backwardly to the aft end of said hull;

a longitudinally extending superstructure located over said hull extending along a portion of the length of said hull upwardly from said deck;

said vertical symmetry plane dissecting said superstructure along its longitudinal axis into essentially symmetrical right and left side halves;

the combined centers of gravity and buoyancy of said hull and said superstructure normally lying essentially in said vertical symmetry plane;

said superstructure including a longitudinally oriented crew supporting means located above the center of buoyancy of said vehicle, and projecting upwardly from said deck, said deck extending from said crew supporting means outwardly to the right and left of said vertical symmetry plane, said crew supporting means sized and shaped to allow one or more crew members to individually straddle said supporting means such that if two or more crew members occupy said vehicle, said crew members are aligned tandemly one behind the other along the length of said supporting means and each of said crew members independently can sit astride said crew supporting means with their legs projecting downwardly and outwardly towards said deck with their feet locatable on the deck;

said crew members capable of freely shifting their center of gravity from a position directly over the center of buoyancy of said vehicle to positions to the right and left such that when the center of gravity of said crew is shifted to the right or left of a point directly over the center of buoyancy of said vehicle, said pressure ridge located on said side of said vertical symmetry plane to which said center of gravity is shifted will be depressed downwardly with respect to the static water line of said vehicle;

runner means located on said hull and extending longitudinally along at least a portion of the length of said hull;

said runner means comprise horizontally oriented, longitudinally extending runners capable of planing on the surface of a body of water when said hull is propelled at a planing velocity across said surface of said body of water;

the aft end of said hull having motor receiving means capable of receiving a motor to propel said vehicle on said body of water;

said hull includes at least three bilge sections, one of said bilge sections located between two of said pressure ridges and the other of said bilge sections each having one of said pressure ridges located intermittent said bilge section and said vertical symmetry plane;

said hull includes two outboard bilge sections and two inboard bilge sections, two longitudinally extending pressure ridges and two runners;

said inboard bilge sections extending from said vertical symmetry plane to the right and left of said vehicle, said pressure ridges integrally formed with said inboard bilge sections distal from the vertical symmetry plane of said vehicle, said runners integrally formed with said pressure ridges distal from the vertical symmetry plane of said vehicle, and said outboard bilge sections integrally formed with said runners distal from the vertical symmetry plane of said vehicle.

8. The vehicle of claim 7 including:

said hull having a right and left side freeboard integrally formed with said outboard bilge sections and extending upwardly and outwardly;

a deck located over said hull;

said superstructure extending upwardly from said deck;

said motor receiving means including a transom located on the aft end of said hull.

9. The vehicle of claim 8 including:

a third runner located along said vertical symmetry plane of said vehicle interspaced between said inboard bilge section.

10. The vehicle of claim 9 including:

a deck interspaced between said superstructure and said hull, said deck extending outwardly from both the right and left sides of said superstructure providing surfaces for said crew to apply forces from the legs of said crew to the right and left sides of said vehicle assisting in shifting the center of gravity of said vehicle.

* * * * *